US007950764B2

(12) United States Patent
Kobayashi

(10) Patent No.: US 7,950,764 B2
(45) Date of Patent: May 31, 2011

(54) PRESSURE REGULATING MECHANISM AND LIQUID EJECTING APPARATUS

(75) Inventor: Atsushi Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 748 days.

(21) Appl. No.: 12/047,577

(22) Filed: Mar. 13, 2008

(65) Prior Publication Data

US 2008/0225090 A1 Sep. 18, 2008

(30) Foreign Application Priority Data

Mar. 16, 2007 (JP) ..... 2007-068335
Dec. 27, 2007 (JP) ..... 2007-336834

(51) Int. Cl.
*B41J 29/38* (2006.01)
*B41J 2/19* (2006.01)

(52) U.S. Cl. ..... 347/17; 347/92

(58) Field of Classification Search ..... 347/17, 347/92

See application file for complete search history.

(56) References Cited

U.S. PATENT DOCUMENTS

2005/0134661 A1* 6/2005 Miyazawa ..... 347/86

FOREIGN PATENT DOCUMENTS

| | | |
|---|---|---|
| JP | 2005-186344 | 7/2005 |
| JP | 2006-075683 | 3/2006 |
| JP | 2006-327097 | 12/2006 |
| JP | 2007-007043 | 1/2007 |
| JP | 2007-031627 | 2/2007 |

* cited by examiner

*Primary Examiner* — Uyen-Chau N Le
*Assistant Examiner* — Kajli Prince
(74) *Attorney, Agent, or Firm* — Workman Nydegger

(57) ABSTRACT

A pressure regulating mechanism which includes a pressure regulating chamber that introduces a liquid from a liquid supply source through an inlet port, stores the liquid, and discharges the stored liquid to an object through an outlet port, an on/off valve, a pressure receiving member that is provided to seal an opening surface of the pressure regulating chamber, a reduced-pressure space portion adjacent to the regulating chamber with a pressure that may be reduced to be less than the pressure of the pressure regulating chamber, and a partition wall disposed between the pressure regulating chamber and reduced-pressure space portion, wherein gas is capable of passing through the partition wall using the a difference in pressure between the reduced-pressure space and pressure regulating chamber and discharged to the reduced-pressure space portion.

16 Claims, 7 Drawing Sheets

PRESSURE REGULATING MECHANISM AND LIQUID EJECTING APPARATUS

The entire disclosures of Japanese Patent Application Nos. 2007-068335, filed Mar. 16, 2007 and 2007-336834, filed Dec. 27, 2007 are expressly incorporated herein by reference.

BACKGROUND OF THE INVENTION

1. Technical Field

The present invention relates to a pressure regulating mechanism that is used in a liquid ejecting apparatus. More specifically, the present invention relates to a pressure regulating mechanism that has a pressure receiving member which is capable of deforming inside a pressure regulating chamber when the pressure in the pressure regulating chamber is reduced to be less than a predetermined pressure.

2. Related Art

Liquid ejecting apparatuses currently known in the art have liquid ejecting heads that are capable of discharging various kinds of liquids. One type of liquid ejecting apparatus is an image recording apparatus that discharges ink droplets onto a recording medium, such as paper, during a recording process. In addition, liquid ejecting apparatuses have been used in various manufacturing apparatuses, such as liquid crystal displays, plasma displays, organic EL (Electro Luminescence) displays, or FEDs (Field Emission Displays). Such liquid ejecting apparatuses are used to discharge various liquid materials, such as color materials or electrode materials, onto image forming regions or electrode forming regions.

In an "off-carriage" type of liquid ejecting apparatus, such as the apparatus described in Japanese Patent Application No. JP-A-2005-186344, a liquid supply source (ink cartridge) is disposed in an apparatus main body, and a pressure regulating mechanism is used to supply ink from a liquid supply source to the liquid ejecting head. The pressure regulating mechanism regulates the pressure of the ink to a predetermined pressure. The liquid supply source and the pressure regulating mechanism are connected with each other by a flexible liquid supply tube.

The pressure regulating mechanism includes a pressure regulating chamber stores a liquid and has an inlet port and an outlet port, an on/off valve that opens and closes the inlet port, a biasing member that biases the on/off valve toward the inlet port, a film member that is stretched to seal an opening surface of the pressure regulating chamber, and an actuating lever adhered to the film member. In this configuration, if an internal pressure of the pressure regulating chamber is reduced to less than a predetermined pressure, the film member is elastically deformed inside the pressure regulating chamber, and the actuating lever presses the on/off valve to an open position by an actuating force obtained when the film member is elastically deformed, and ink flows into the pressure chamber through the inlet port.

Ideally, the ink flow passage from the ink cartridge to nozzle openings of a recording head is filled with ink. However, in the configuration described above, it is often difficult to completely prevent air bubbles from entering the ink flow passage. Particularly, in configurations where a pressure regulating mechanism is used, external gas (air) may pass through the film member and mix with ink in the pressure regulating chamber, resulting in the formation of air bubbles. Unfortunately, however, if the air bubbles are able to move toward the recording head, the change in the ink pressure created during the discharge operation may be absorbed by the air bubbles, resulting in pressure loss. In addition, the air bubbles may block the flow passage, which may create difficulties adequately supplying the ink to the recording head.

BRIEF SUMMARY OF THE INVENTION

An advantage of some aspects of the invention is that it provides a pressure regulating mechanism capable of discharging gas in a pressure regulating chamber, thereby preventing gases mixed in the liquid in the liquid ejecting apparatus.

According to an aspect of the invention, a pressure regulating mechanism includes a pressure regulating chamber that is capable of receiving a liquid from a liquid supply source through an inlet port, storing the liquid, and discharging the stored liquid through an outlet port, an on/off valve that is capable of switching between a valve open state, wherein the liquid is blocked from the inlet port of the pressure regulating chamber, and closed state, wherein the liquid may flow from the inlet port to the pressure regulating chamber, a pressure receiving member that is capable of sealing an opening in one side of the pressure regulating chamber, a reduced-pressure space portion formed adjacent to the pressure regulating chamber with a pressure that is capable of being reduced by a pressure reducing unit to less than the pressure in the pressure regulating chamber, and a transmissive partition wall disposed between the reduced-pressure space portion and the pressure regulating chamber which is capable of transferring gas in the pressure regulating chamber to the reduced-pressure space portion using the difference between the pressure in the pressure reducing unit and the pressure in the pressure regulating chamber. In the pressure regulating mechanism, if the pressure in the pressure regulating chamber is reduced to less than a predetermined pressure, the pressure receiving member is deformed so as to unseal the opening in the side of the pressure regulating chamber, and causing the on/off valve to switch from the close state to an open state.

According to another aspect of the invention, a liquid ejecting apparatus includes the above-described pressure regulating mechanism. A liquid, which is stored in a liquid storage member as a liquid supply source, is introduced into the pressure regulating mechanism through a liquid supply path, and after a pressure is regulated by the pressure regulating mechanism, the liquid is supplied to a liquid ejecting head and is then discharged by the liquid ejecting head.

Another aspect of the invention is a liquid ejecting apparatus that includes the above-described pressure regulating mechanism. In addition, the liquid ejecting apparatus comprises a liquid, which is stored in a liquid storage member, introduced into the pressure regulating mechanism through a liquid supply path, and regulated by the pressure regulating mechanism, so as to be supplied to a liquid ejecting head, discharged by the liquid ejecting head.

In each configuration, the mixed gas in the pressure regulating chamber can be discharged, meaning that the formation of air bubbles can be suppressed in the pressure regulating chamber. Thus, difficulties arising from air bubbles being mixed with the liquid during the liquid ejection process can be eliminated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will now be described with reference to the accompanying drawings. Note that the embodiments described herein are illustrative only, and the scope of the invention is not limited to such embodiments unless a definition limiting the invention is provided. In this embodiment, a description will be given using an example of an ink jet printer (hereinafter, simply referred to as 'printer'), as an image recording apparatus, which is an example of a liquid ejecting apparatus.

Figure 1:
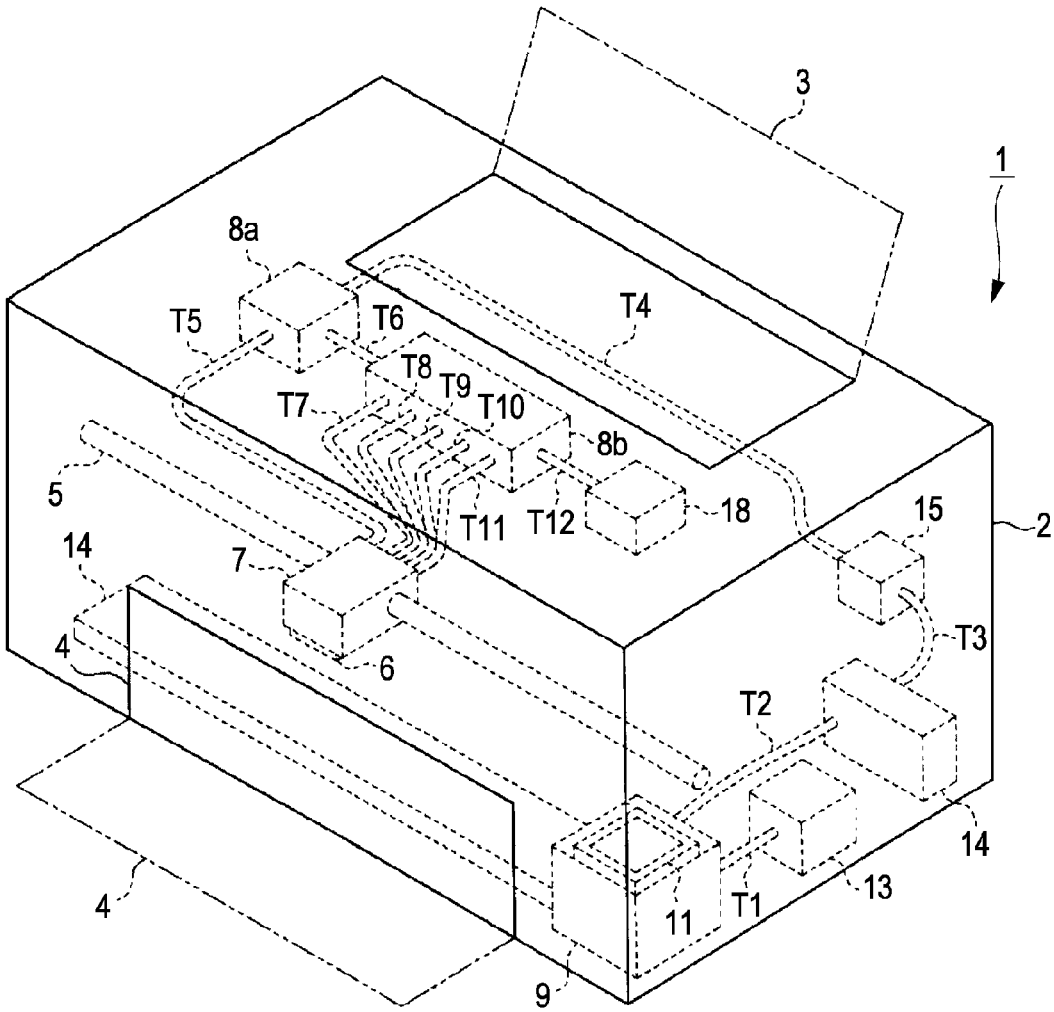
FIG. 1 is a perspective view showing the internal configuration of a printer.
Figure 2:
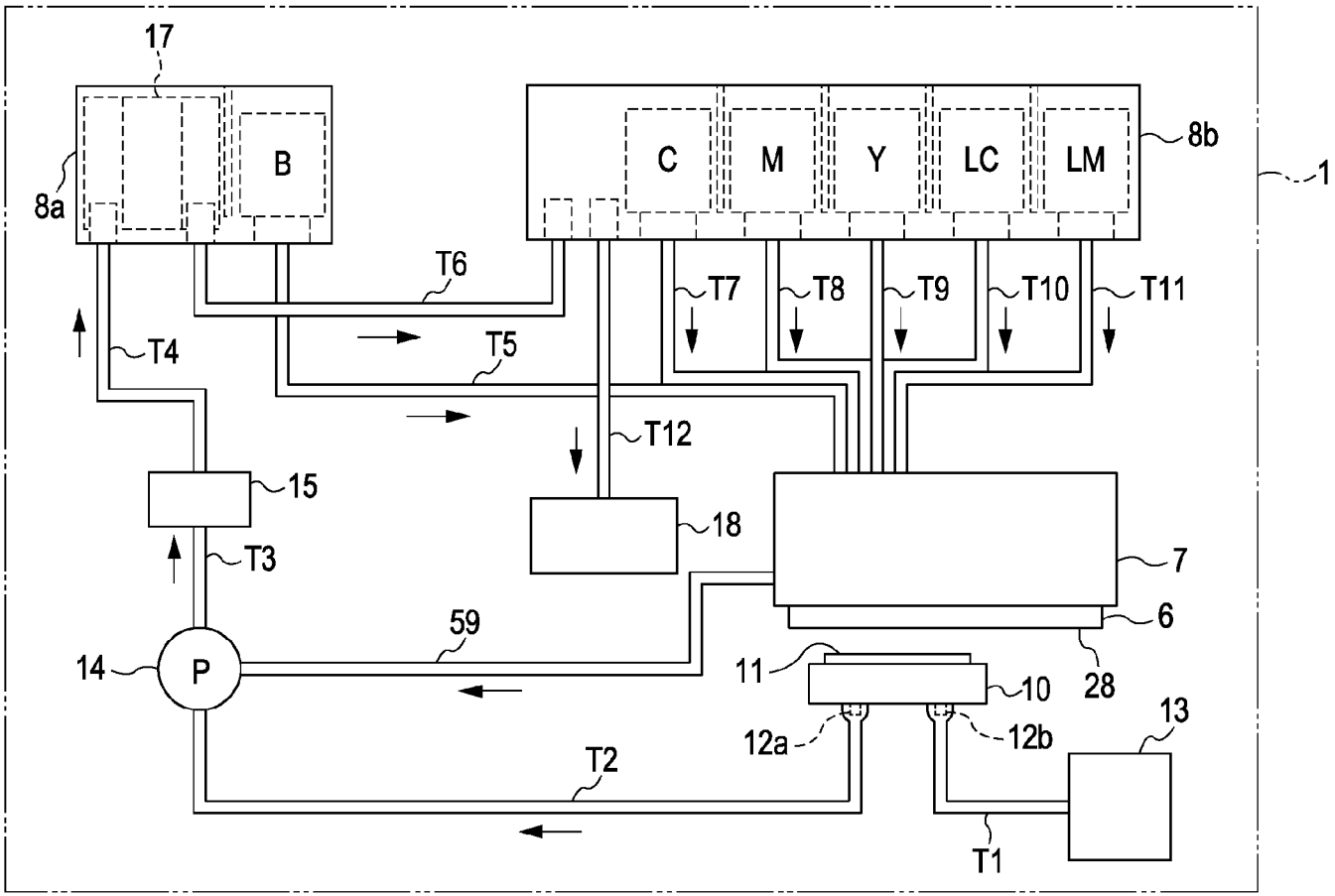
FIG. 2 is a schematic view showing the internal configuration of the printer.

FIG. 1 is a perspective view schematically showing the internal configuration of a printer. FIG. 2 is a schematic view illustrating the internal configuration of the printer. A printer 1 includes a casing 2, a paper feed tray 3, and a paper discharge tray 4. The casing 2 is a shell member that covers the entire printer 1. The paper feed tray 3 is provided at the top of the casing 2, and the paper discharge tray 4 is provided in a front lower portion of the casing 2. A sheet of recording paper is used as a printing object on which to be printed (an object to be discharged or an object to be ejected) and is set on the paper feed tray 3. During the printing process, the recording paper set on the paper feed tray 3 is fed to a platen 14 in the printer 1 by a paper feed mechanism (not shown). The paper discharge tray 4 guides and discharges the recording paper through the printer during the printing process to the outside of the printer 1.

A guide rod 5 is provided in a longitudinal direction (horizontal direction) within the casing 2. A carriage 7 on which a recording head 6 and an ink pressure regulating unit 36, described more fully below, are mounted to the guide rod 5 so as to be movably axially supported. The carriage 7 is connected to a driving motor (pulse motor) (not shown) through a driving belt. If the driving motor rotates, a driving force is transferred through the driving belt, and the carriage 7 reciprocates in a main scanning direction along the guide rod 5.

Figure 3:
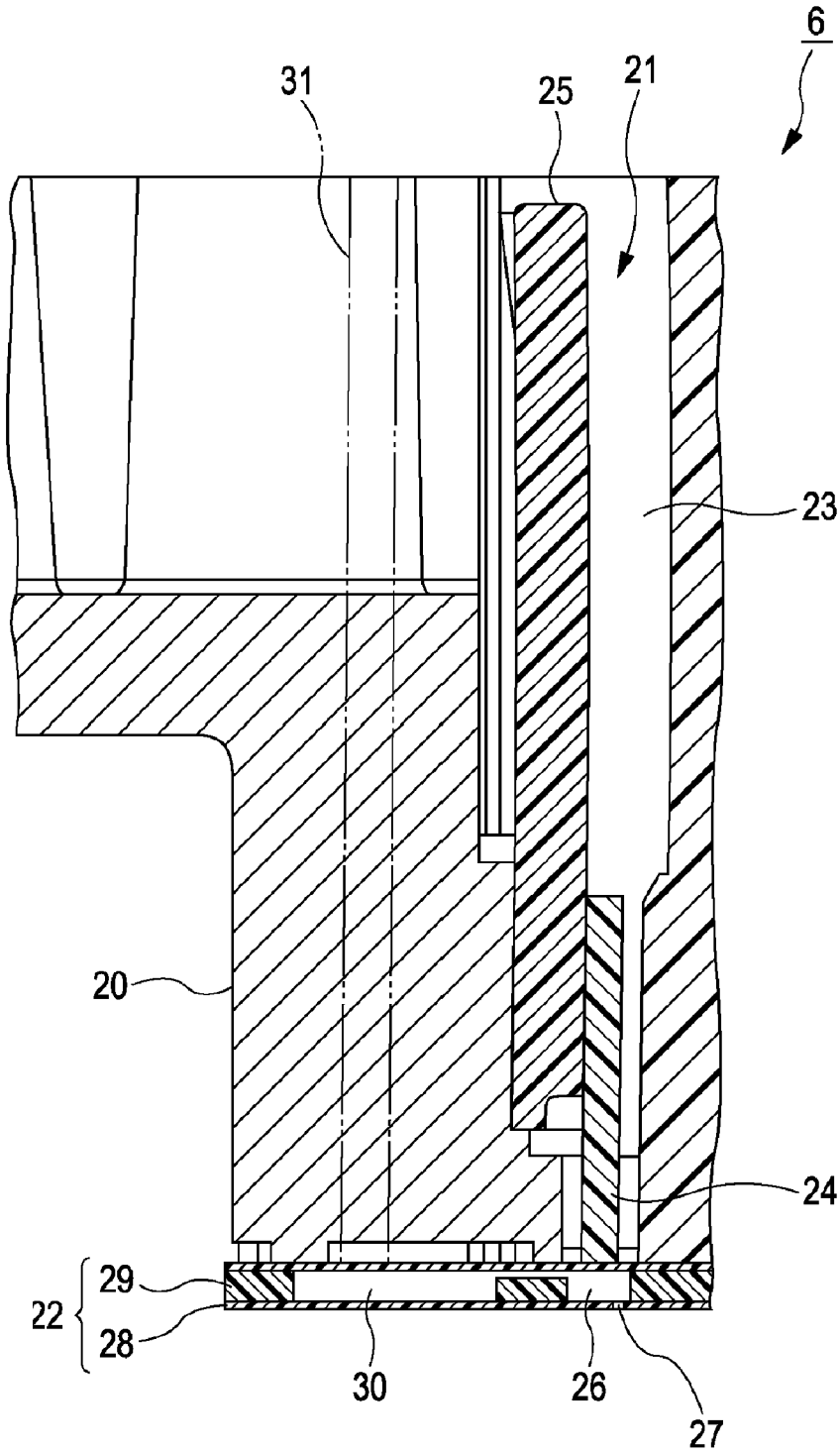
FIG. 3 is a cross-sectional view illustrating the configuration of a recording head.

The recording head 6 that is provided on a lower surface of the carriage 7 (a surface facing the platen 14) functions as a liquid ejecting head with a nozzle forming surface, referred to as a nozzle forming substrate 28, as shown in FIG. 3, which faces the recording paper. In the nozzle forming surface, a plurality of nozzle rows (not shown) are formed, each having a plurality of nozzle openings. In this embodiment, there are 6 nozzle rows, although this example is illustrative only. The recording head 6 houses ink in the form of colored liquids. In this embodiment, the colored liquid ink comprises six colors of ink, including black, cyan, magenta, yellow, light cyan, and light magenta, each of which correspond to a nozzle row. The inks are supplied from first and second ink cartridges 8*a* and 8*b* which act as a liquid supply source or a liquid storage member in the casing 2, as described below. As shown in FIG. 3, the ink flowing in the recording head 6 is pressurized by operating a piezoelectric element 24, and discharging ink droplets from the nozzle openings of the recording head 6 to form dots on the recording paper. That is, the black, cyan, magenta, yellow, light cyan, and light magenta ink are discharged from the nozzle openings of the nozzle rows in the recording head 6 in a coordinated manner in order to form an image on the recording paper.

The region where the ink lands on the recording paper during a printing process is referred to as a printing region. Further, the position where the carriage 7 is disposed when the printer 1 is in an idle or non-printing state is provided in a region outside the printing region, and is referred to as a home position. In FIG. 1, the home position is in the right front side.

A capping mechanism 9 is provided at the home position. The capping mechanism 9 has a cap holder 10 (shown in FIG. 2) that may be vertically moved by a lift mechanism (not shown). A cap member 11 that serves as a sealing unit is provided on the cap holder 10. The cap member 11 is a tray-shaped member having an opened top surface which formed of, for example, an elastic member, such as an elastomer.

Inside the cap member 11, an absorbing member is provided to absorb ink. The cap member 11 is formed of a porous material which is capable of absorbing ink. Through-holes 12*a* and 12*b* are formed at the bottom of the cap member 11. An air opening valve 13 is connected to the through-hole 12*b* through a tube T1. The air opening valve 13 allows the sealed space that is formed by bring the cap member 11 into close contact with the nozzle forming surface to become unsealed by being exposed to the surrounding air. The through-hole 12*a* is connected to a pump unit 14 through a tube T2. The pump unit 14 is comprised of a tube pump that squeezes a tube with a roller to supply a liquid or a gear pump which rotates a driving gear which supplies a liquid to a downstream side. The pump unit 14 absorbs and discharges ink or air bubbles in the cap member 11. That is, when the nozzle forming surface is sealed with the cap member 11, if the pump unit 14 is driven, a negative pressure is applied to the nozzle openings of the nozzle forming surface. Then, a cleaning operation is performed to forcibly discharge ink or air bubbles (gas) from the nozzle openings.

A regulating device 15 is connected to a downstream side of the pump unit 14 through a tube T3, and the first ink cartridge 8*a* is connected to the regulating device 15 through a tube T4. The first ink cartridge 8*a* accommodates an ink pack B that stores black ink, and an ink absorbing body 17 that absorbs ink. The ink pack B is connected to the carriage 7 through a tube T5. The ink absorbing body 17 is formed of an absorbent porous material, such as sponge.

In this configuration, waste ink or gas that is absorbed from the cap member 11 by the pump unit 14 flows into the first ink cartridge 8*a*. At this time, the waste ink flowing in the first ink cartridge 8*a* is absorbed by the ink absorbing body 17. In addition, the amount of the waste ink and gas flowing in the first ink cartridge 8*a* and the flow rate are regulated by the regulating device 15.

The second ink cartridge 8*b* is connected to the first ink cartridge 8*a* through a tube T6 which allows the two ink cartridges 8*a* and 8*b* to communicate with each other. The second ink cartridge 8*b* has ink packs C, M, Y, LC, and LM that correspond to cyan ink, magenta ink, yellow ink, light cyan ink, and light magenta ink. The ink packs C, M, Y, LC, and LM are connected to the carriage 7 through tubes T7 to T11, respectively. In addition, an air opening device 18 is connected to the second ink cartridge 8*b* through a tube T12 to allow the inside of the second ink cartridge 8*b* to be atmospherically exposed.

If the pump unit 14 is driven, the waste ink and gas is absorbed from the cap member 11, then sequentially flows the cap member 11, the tube T2, the pump unit 14, the tube T3, the regulating device 15, and the tube T4, and subsequently flows into the ink cartridge 8*a*. At this time, since the waste ink flowing in the first ink cartridge 8*a* is absorbed by the above-described ink absorbing body 17, only the incoming gas (pressurized air) flows in the first ink cartridge 8*a*. Then, the pressurized air flows into the second ink cartridge 8*b* through the tube T6 from the first ink cartridge 8*a*, and then moves to the air opening device 18 that is connected to the tube T12.

When the pump unit 14 operates, the internal pressure in the first and second ink cartridges 8*a* and 8*b* is pressurized by the above-described pressurized air, and then the ink packs B, C, M, Y, LC, and LM are pressurized. Accordingly, ink stored in each of the ink packs B, C, M, Y, LC, and LM is pumped to the recording head 6 of the carriage 7.

In the printer 1 of this embodiment, the pump unit 14 comprises a cleaning pump that applies a negative pressure to a sealing space portion of the cap member 11, and a pressure pump that pressurizes the ink packs B, C, M, Y, LC, and LM. Therefore, when the pump unit 14 is driven, a negative pressure is applied to the cap member 11 to absorb the waste ink and air, and the ink packs B, C, M, Y, LC, and LM are pressurized to pump ink to the recording head 6.

Next, the recording head 6 that is mounted on the printer 1 will be described. FIG. 3 is a cross-sectional view showing the essential parts of the recording head 6. In this embodiment, the recording head 6 schematically includes a head case 20, a vibrator unit 21, and a flow passage unit 22.

The head case 20 is a hollow box-like member. The flow passage unit 22 is fixed to a front end surface (lower surface) of the head case 20, and the vibrator unit 21 is housed in a housing space portion 23 of the head case 20. In addition, a case flow passage 31 is formed to pass through the head case 20 in a vertical direction. An upstream end of the case flow passage 31 communicates with a downstream communicating port 34 of the ink pressure regulating unit 36 described below, and a downstream end of the case flow passage 31 communicates with a common ink chamber 30 of the flow passage unit 22.

The vibrator unit 21 includes a plurality of piezoelectric elements 24 which are fixed to a fixing substrate 35 in a comb-like shape. Each piezoelectric element 24 acts as a kind of a pressure generating unit. A wiring member (not shown) supplies a driving signal to the piezoelectric elements 24. Each of the piezoelectric elements 24 is bonded to a diaphragm (vibrating plate) that partitions the pressure chamber 26 in the flow passage unit 22. When a driving signal is supplied, the piezoelectric elements 24 expand and contract to expand and contract the volume of the pressure chamber 26. Accordingly, ink in the pressure chamber 26 is pressurized, such that the ink droplets can be discharged from the nozzle openings 27 by controlling the change in pressure in the pressure chamber 26.

The flow passage unit 22 is formed by laminating the nozzle forming substrate 28, on which the nozzle rows having arranged the nozzle openings 27 are formed, or a flow passage forming substrate 29, which forms the ink flow passage, and bonding them with an adhesive to form a single body. The low passage unit 22 is a unit member that forms an ink flow passage from the common ink chamber 30 (common liquid chamber) to the nozzle openings 27 through an ink supply port and the pressure chamber 26. In the flow passage unit 22, a pressure chamber 26 is formed in each nozzle opening 27, such that ink is supplied from the ink pressure regulating unit 36 of the carriage 7 through the common ink chamber 30.

The printer 1 transfers the recording paper in a sub-scanning direction, and drives the piezoelectric elements 24 according to image signals (dot pattern data) generated using print data while reciprocating the carriage 7 in the main scanning direction, in order to discharge ink (ink droplets) from the recording head 6. In this way, the printer 1 records images or text on the recording paper.

Next, the ink pressure regulating unit 36 that is mounted on the carriage 7 will be described.

Figure 4:
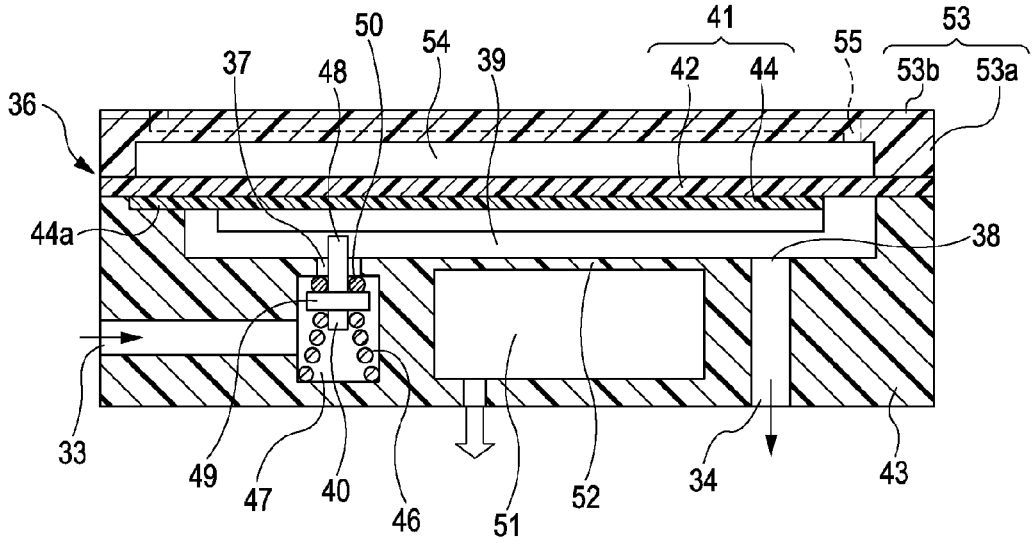
FIG. 4 is a cross-sectional view illustrating the configuration of an ink pressure regulating unit.
Figure 5:
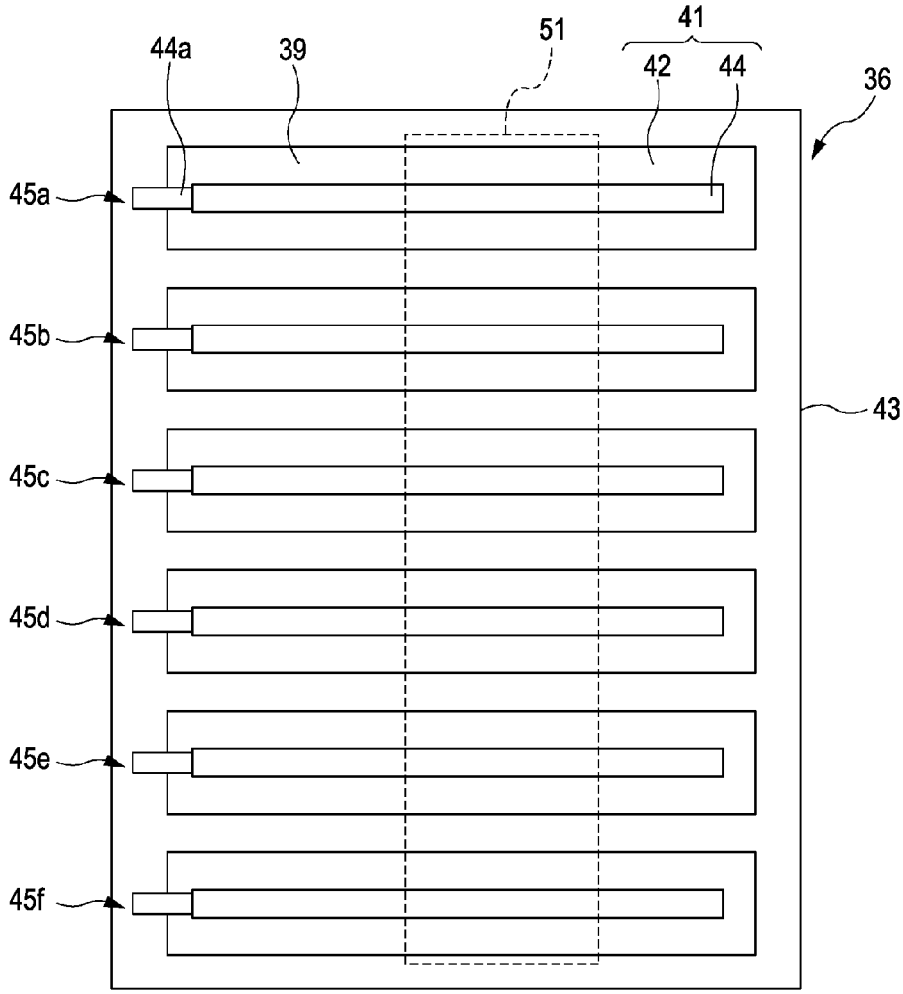
FIG. 5 is a plan view illustrating the configuration of the ink pressure regulating unit.

FIG. 4 is a cross-sectional view of the ink pressure regulating unit 36 according to one embodiment of the invention. FIG. 5 is a plan view of the ink pressure regulating unit 36. The ink pressure regulating unit 36 includes pressure regulating sections 45*a*-45*f* in a unit main body 43. Each of the pressure regulating sections 45*a*-45*f* includes a pressure regulating chamber 39 that introduces and stores ink supplied from the cartridge 8 through an upstream communicating port 33 and an inlet port 37, and discharges the stored ink to the recording head 6 through an outlet port 38 and the downstream communicating port 34, an on/off valve 40 that is provided to be switched between a valve close state where ink from the inlet port 37 is blocked from flowing to the pressure regulating chamber 39, and a valve open state, where ink from the inlet port 37 is introduced to the pressure regulating chamber 39, and a pressure receiving member 41 that is provided to seal an opening on one side of the pressure regulating chamber 39. The pressure regulating sections 45*a* to 45*f* are provided to correspond to each color of ink. In this embodiment, as shown in FIG. 5, six pressure regulating sections 45*a* to 45*e* are horizontally arranged in the unit main body 43. The unit main body 43 is formed of synthetic resin.

The pressure regulating chamber 39 is composed of a long rectangular depression that is perpendicular to the arrangement direction of the pressure regulating sections 45*a* to 45*f*. In this embodiment, the depth of the depression is ⅓ of the thickness of the unit main body 43. In addition, the inlet port 37 is provided at one end in the bottom of the pressure regulating chamber 39 in the longitudinal direction (the left side of FIG. 4), and the outlet port 38 is provided at the other end of the bottom of the pressure regulating chamber 39 (the right side of FIG. 4).

The pressure receiving member 41 includes a flexible film member 42 that is capable of elastically deforming inside the pressure regulating chamber 39 when the internal pressure of the pressure regulating chamber 39 is reduced to be less than a predetermined pressure, and an actuating lever 44 that is provided inner than the film member 42 (near the pressure regulating chamber 39). The film member 42 is formed by depositing silica ($SiO_2$) as an airtight layer on a surface of a flexible film, which is a laminate of, for example, a polyethylene terephthalate film and a polypropylene film. If the airtight layer is provided, gas is suppressed from passing through the film member 42. The film member 42 is adhered or welded to the surface of the unit main body 43 to seal the opening of the depression serving as the pressure regulating chamber 39. Accordingly, the film member 42 partitions a part of the pressure regulating chamber 39.

The actuating lever 44 is provided such that one end 44*a* thereof is supported by the unit main body 43 in the pressure regulating chamber 39 in a so-called cantilever manner. Then, the on/off valve 40 is disposed to receive an actuating force from the actuating lever 44 when the actuating lever 44 is tilted. Moreover, the actuating lever 44 is formed of, for example, a metal plate material, such as stainless steel.

The on/off valve 40 is configured to be switched between the valve open state, wherein ink is introduced to the pressure regulating chamber 39, and a valve close state (shown in FIG. 1), wherein ink is not introduced to the pressure regulating chamber 39. The on/off valve 40 is provided in a housing chamber 47, which is formed on an upstream side of the inlet port 37, while being biased to a valve close position by a biasing member 46 formed of a deformed coil spring. The on/off valve 40 includes a cylindrical shaft 48, a disc-shaped collar 49 that extends sideward at the middle of the shaft 48 in the longitudinal direction, and a packing 50 that is disposed on an upper surface of the collar 49 (near the pressure regulating chamber 39). A front end of the shaft 48 (the portion extending beyond the collar 49) is formed with an outer diameter that is less than the inner diameter of the inlet port 37. The shaft 24 is inserted into the pressure regulating chamber 39 through the inlet port 37. Then, ink from the upstream communicating port 33 is introduced into the pressure regulating chamber 39 through a gap between the shaft 48 and the inner circumference of the inlet port 37. The packing 50 is formed of, for example, an elastic material, such as an elastomer, in a so-called O ring shape.

The biasing member 46 comes into contact with the collar 49 of the on/off valve 40 to bias the on/off valve 40 to the pressure regulating chamber 39, to thereby hold the on/off valve 40 in the close valve state until the pressure regulating chamber 39 is reduced to the predetermined pressure. That is, the on/off valve 40 is biased to the ceiling surface of the housing chamber 47 by the biasing member 46 unless there is a opposing elastic force, meaning that the packing 50 comes into close contact with the opening edge of the inlet port 37. At the valve close position, the on/off valve 40 blocks the inflow of ink into the pressure regulating chamber 39.

If the inflow of ink into the pressure regulating chamber 39 is blocked by the on/off valve 40, the internal pressure of the pressure regulating chamber 39 gradually reduces as ink is consumed by the recording head 6. If the pressure in the pressure regulating chamber 39 is reduced to the predetermined pressure (or the minimum pressure at which the recording head 6 is able to adequately discharge ink) the pressure receiving member 41 is elastically deformed towards the inside the pressure regulating chamber 39, which presses the actuating lever 44 downward. Accordingly, the actuating lever 44 presses the front end of the shaft 48 of the on/off valve 40 using an actuating force which moves the on/off valve 40 in an open direction by applying a force against the elastic force of the biasing member 46. Then, the packing 50 is moved away from the opening edge of the inlet port 37, and the on/off valve 40 is placed in a valve open position. At the valve open position, ink is introduced into the pressure regulating chamber 39 through the inlet port 37. As the ink is introduced into the pressure regulating chamber 39, the internal pressure of the pressure regulating chamber 39 gradually increases to be more than the minimum pressure. If the internal pressure of the pressure regulating chamber 39 is increased, the film member 42 is displaced outward the pressure regulating chamber 39. Then, the elastic force of the biasing member 46 displaces the on/off valve 40 to the valve close position again to block the flow of ink into the pressure regulating chamber 39.

Using this procedure, the ink pressure regulating unit 36 regulates the pressure of the ink supplied to the recording head 6 to a predetermined pressure by alternating the on/off valve 40 between the valve close position and the valve open position. This prevents any excessive increase in pressure from forming which might cause a failure in the ink discharge.

In the ink pressure regulating unit 36 having the above-described configuration, external gas (air) may pass through the film member 42, mix with ink in the pressure regulating chamber 39, and form air bubbles. If these air bubbles form and move to the recording head 6, the change in pressure created during a discharge operation may be absorbed by the air bubbles and pressure loss may occur. In addition, the ink flow passage may be blocked, creating an insufficient ink supply. For this reason, the cover member 53 in the ink pressure regulating unit 36 is provided outside the pressure regulating chamber 39 with the pressure receiving member 41 being interposed between, so as to cover the entire surface of the pressure receiving members of the pressure regulating sections 45*a* to 45*f*.

Figure 6:
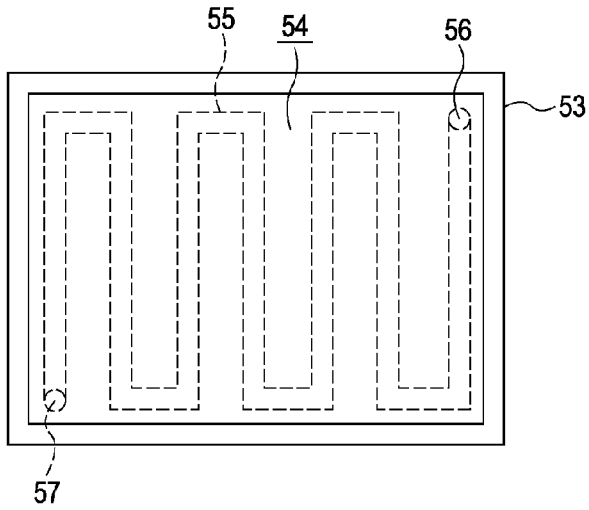
FIG. 6 is a plan view illustrating the configuration of a cover member.

FIG. 6 is a plan view of the cover member 53 as viewed from the opening surface of the pressure regulating unit 36. The cover member 53 is formed in a rectangular shape so as to correspond to the planar shape of the ink pressure regulating unit 36. The cover member 53 is a tray-shaped member that has an opened surface to face the pressure receiving member 41. In this embodiment, as shown in FIG. 4, the cover member 53 has a two-layered structure comprised of a main body 53*a* and a sealing member 53*b*. A groove-shaped flow passage in the main body 53*a* is sealed by the sealing member 53*b*, such that the air communicating path 55 is formed in the cover member 53. In addition, the cover member 53 is bonded to the unit main body 43 so that the sealing space portion 54 is formed between the cover member 53 and the pressure receiving member 41.

The sealing space portion 54 is a space with a size such that, when the pressure receiving member 41 is displaced as far as possible from the pressure regulating chamber 39, the cover member 53 does not interfere with the pressure receiving member 41. The sealing space portion 53 communicates with the air through the air communicating path 55. The air communicating path 55 is a flow passage that communicates an inner opening 56 in the sealing space portion 54 with an outer opening 57 at the outer surface of the cover member 53. As indicated by a broken line in FIG. 6, the air communicating path 55 is formed with a zigzagged shape such that the length of the path is as long as possible, so that the sealing space portion 54 can be exposed to the surrounding air in order to allow the pressure receiving member 41 to be displaced. In addition, water vapor in the sealing space portion 54 can be kept from escaping through the air communicating path 55.

If the above-described cover member 53 is provided in the ink pressure regulating unit 36, the humidity in the sealing space portion 54 can be as high as possible (a state close to water vapor saturation). Accordingly, a difference in partial pressure between the sealing space portion 54 and the pressure regulating chamber 39 can be suppressed, preventing gas from entering through the pressure receiving member 41. As a result, it is possible to prevent air bubbles from being mixed with the ink.

As shown in FIGS. 4 and 5, a reduced-pressure space portion 51 is formed near the bottom of the pressure regulating chamber 39. The pressure in the reduced-pressure space portion 51 is reduced to be less than the pressure in the pressure regulating chamber 39 by a pressure reducing unit, described more fully below. As the pressure in the reduced-pressure space portion 51 is reduced, gas and air bubbles in the pressure regulating chamber 39 pass through the partition wall between the reduced-pressure space portion 51 and the pressure regulating chamber 39, where the gas and air are then discharged to the reduced-pressure space portion 51.

The reduced-pressure space portion 51 has a long boxlike shape that is formed along the arrangement direction of the pressure regulating sections 45*a* to 45*f*. As indicated by a broken line in FIG. 5, the reduced-pressure space portion 51 is formed over the pressure regulating sections 45*a* to 45*f*. The reduced-pressure space portion 51 is formed to face the pressure regulating chamber 39 with the partition interposed in-between. The partition wall is formed to have a thickness that is less than partition walls that are formed separately from the main unit body 43. That is, the transmissive partition wall 52 is a part of the unit main body 43 which forms the ink pressure regulating unit 36. The transmissive partition wall 52 is integrally formed with the unit main body 43 using the same material as the unit main body 43, and has a thickness smaller than other walls of the unit main body 43 which come into contact with external air. Because the transmissive partition wall 52 is a component of the unit main body 43, the processes of molding an additional transmissive partition wall 52 and unit main body 43 and assembling them together can be omitted. In addition, the gas transmission properties can be more increased than the additional partition wall.

The transmissive partition wall 52 preferably comprises a rigid wall, which has rigidity enough to maintain its shape when a change in pressure is applied to the pressure regulating chamber 39, with a thickness that allows gas exchange or gas transmission caused by a difference in pressure between the pressure regulating chamber 39 and the reduced-pressure space portion 51. For example, as the material for the unit main body 43 including the transmissive partition wall 52 may be plastic, such as POM (polyacetal), m-PPE (modified polyphenylene ether), PP (polypropylene), or an alloy of them is preferably used. In addition, the thickness of the transmissive partition wall 52 is preferably set to be approximately 10% to 50% of the average thickness of other portions, generally, about 0.5 mm.

Figure 7:
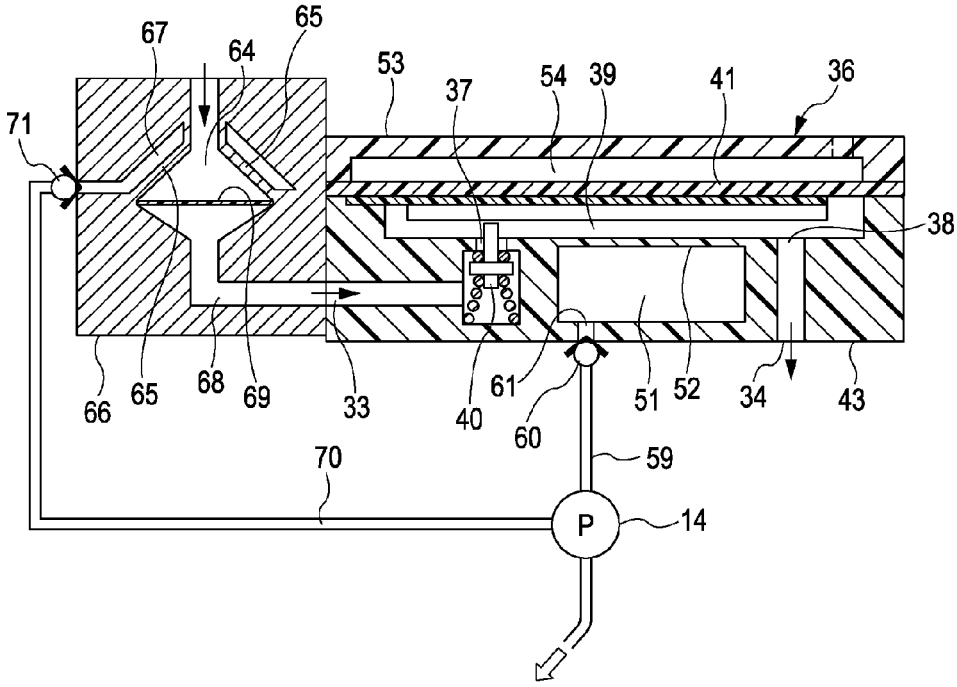
FIG. 7 is a schematic view illustrating the configuration in which a pressure in a reduced-pressure space portion is reduced by a pressure reducing unit.

The pressure in the reduced-pressure space portion 51 is reduced to be less than the internal pressure of the pressure regulating chamber 39 by the pressure reducing unit, such that any gas (air bubbles) in the pressure regulating chamber 39 passes through the transmissive partition wall 52 and is discharged to the reduced-pressure space portion 51. FIG. 7 is a schematic view illustrating the configuration in which the pressure in the reduced-pressure space portion 51 is reduced by the pressure reducing unit. In this embodiment, as shown in FIG. 7, the cleaning pump unit 14 is used as the pressure reducing unit. Specifically, a suction path 59 connected to the reduced-pressure space portion 51 is connected to the pump unit 14 in parallel with the tube T2 (see FIG. 2) in order to reduce the pressure in the cap member 11 and the pressure in the reduced-pressure space portion 51. Moreover, the suction path 59 is connected to an exhaust port 61 of the reduced-pressure space portion 51 through a check valve 60, which allows air to flow from the reduced-pressure space portion 51 to the pump unit 14 and without allowing the air to flow backward.

In this configuration, when the pump unit 14 operates, the pressure in the reduced-pressure space portion 51 is reduced through the suction path 59. Accordingly, the pressure in the reduced-pressure space portion 51 can be reduced to be less than the pressure in the pressure regulating chamber 39. Using this difference in pressure, gas (air bubbles) in the pressure regulating chamber 39 is discharged to the reduced-pressure space portion 51 through the transmissive partition wall 52. Therefore, even if gas is able to pass through the pressure receiving member 41 and mix with ink in the pressure regulating chamber 39, the gas can be discharged. Thus, air bubbles can be suppressed in the pressure regulating chamber 39, and the difficulties caused by air bubbles in the recording head 6 can be prevented. In addition, since the frequency of the cleaning operation to discharge the air bubbles is less than the related art, ink consumption according to the cleaning operation can be reduced.

In the above-described configuration, by setting a threshold value of pressure sufficient to open the check valve 60 or setting a suction time of the pump unit 14, the magnitude of the negative pressure that is applied to the reduced-pressure space portion 51 can be easily regulated. That is, a control unit (not shown) of the printer 1 may regulate the pressure in the reduced-pressure space portion 51 in order to create an adequate difference in pressure between the reduced-pressure space portion 51 and the pressure regulating chamber 39. In addition, the difference in pressure may be set such that the transmission speed of gas which passes through the transmissive partition wall 52 is higher than the inflow speed of gas which passes through the pressure receiving member 41 into the pressure regulating chamber 39. In this embodiment, the difference in pressure is preferably set to be equal to or higher than a saturated water vapor pressure at an ambient temperature around the pressure regulating chamber 39. Specifically, the difference in pressure is preferably in a range of 5 kPa to 30 kPa at a normal temperature (25° C.). As such, if the difference in pressure is set, gas can be effectively prevented from growing in the pressure regulating chamber 39. Moreover, even when the difference in pressure is 5 kPa or less and the state is maintained for a long time, the same advantages can be obtained. Therefore, the difference in pressure need only be higher than 0 kPa.

In embodiments where the volume of the reduced-pressure space portion 51 limited or the pressure reducing capability of the pressure reducing unit is small, it may be difficult to reliably suppress the formation of air bubbles. However, in these embodiments, the humidity in the sealing space portion 54 may be set to be as high as possible using the cover member 53, keeping the gas from passing through the pressure receiving member 41 and entering the pressure regulating chamber 39. Similarly, an airtight layer may be provided on the pressure receiving member 41, such that the airtight layer suppresses gas from passing through the film member 42. For this reason, even with the above-described limitations, air bubbles can be more reliably prevented.

The transmissive partition wall 52 is composed of a rigid wall to have a higher rigidity than other transmissive partition walls, such as gas transmissive films, like silicon. Accordingly, when the difference in pressure is generated by the pressure difference applying unit, the transmissive partition wall is not deformed or damaged, meaning that the ink is suppressed from leaking through the transmissive partition wall. In addition, no change in pressure in the pressure regulating chamber 39 occurs when the transmissive partition wall 52 is bent due to the change in pressure by the pressure difference applying unit. As a result, erroneous operation of the ink pressure regulating unit 36 can be suppressed.

The above-described configuration suppresses gas from entering through the pressure receiving member 41. In addition, in order to reliably suppress additional air bubbles, it is important to suppress the occurrence of air bubbles on the upstream side above the ink pressure regulating unit 36 as much as possible. For this reason, a gas trapping space portion 64 that is capable of trapping the air bubbles in the liquid supply path is formed in the middle of the liquid supply path from the ink cartridge 8 to the inlet port 37 of the ink pressure regulating unit 36. In addition, a part of a partition wall that partitions the gas trapping space portion 64 is used as a transmissive partition wall 65, and a gas collecting space portion 67 is formed outside the gas trapping space portion 64 with the transmissive partition wall 65 interposed in-between.

Then, the pressure in the gas collecting space portion 67 is reduced to be less then the pressure in the gas trapping space portion 64 by the operation of the pressure reducing unit, such that gas in the gas trapping space portion 64 passes through the transmissive partition wall 65 and is discharged to the gas collecting space portion 67.

In this embodiment, as shown in FIG. 7, a trap portion 66 is provided close to the ink pressure regulating unit 36. The trap portion 66 may be formed separately from the ink pressure regulating unit 36 or may be integrally formed with the ink pressure regulating unit 36 (the unit main body 43). Inside the trap portion 66, a communicating flow passage 68 is formed to connect the tubes connected to the individual ink cartridges with the upstream communicating port 33 of the ink pressure regulating unit 36. At the middle of the communicating flow passage 68, the gas trapping space portion 64 is formed. The gas trapping space portion 64 has a diameter larger than other portions of the communicating flow passage 68 and a filter 69.

The filter 69 is a member that filters ink in the communicating flow passage 68 (liquid supply path). The filter 69 is formed by tightly weaving a metal in a mesh shape. In this embodiment, the filter 69 does not allow air bubbles to pass into the liquid supply path, and traps the air bubbles in the gas trapping space portion 64. As described above, since the gas trapping space portion 64 of this embodiment is formed by expanding the inner diameter of the communicating flow passage 68, the flow rate of ink is slower than compared with other portions having a small inner diameter. For this reason, the incoming air bubbles can not easily go through the filter 69, and thus the air bubbles flowing from the upstream side can be trapped in the upper portion of the filter 69.

A part of the partition wall which partitions the gas trapping space portion 64 is formed to be thinner than other partition walls (a portion that comes into contact with external air), and functions as the transmissive partition wall 65. In addition, the gas collecting space portion 67 is formed on the circumference of the gas trapping space portion 64 with the transmissive partition wall 65 interposed in-between. The transmissive partition wall 65 is composed of a part of the structure for forming the trap portion 66, and is also composed of a rigid wall having rigidity enough to maintain its shape when there is a change in pressure by the pressure reducing unit (the pump unit 14). The transmissive partition wall 65 is provided to release any gas trapped in the gas trapping space portion 64 to the outside. The gas collecting space portion 67 is configured to communicate with the pump unit 14 through a suction path 70, to which the gas collecting space portion 67 is connected through a check valve 71. Then, gas or air bubbles trapped in the gas trapping space portion 64 pass through transmissive partition wall 65 according to the difference in pressure between the gas trapping space portion 64 and the gas collecting space portion 67 by the pressure reducing unit, and are discharged to the gas collecting space portion 67. Accordingly, the air bubbles that are formed in the liquid supply path can be trapped and discharged.

Moreover, a pressure application method may be used to create the difference in pressure between the gas trapping space portion 64 and the gas collecting space portion 67 in addition to the pressure reducing method. In this embodiment, the on/off valve is preferably provided on a downstream side of the gas trapping space portion 64 in the communicating flow passage 68 in order to open/close the communicating flow passage 68.

As described above, if the gas trapping space portion 64 is formed to suppress the occurrence of air bubbles on the upstream side above the ink pressure regulating unit 36 in the middle of the liquid supply path from the ink cartridge to the inlet port 37 of the ink pressure regulating unit 36, the formation of air bubbles in the ink pressure regulating unit 36 can be reliably suppressed. In addition, any difficulties arising due to the air bubbles can be reliably prevented.

A printer 1 which includes the ink pressure regulating unit 36 having the above-described configuration prevents air bubbles from flowing into the flow passage of the recording head 6 from the ink pressure regulating unit 36. As a result, difficulties due to the air bubbles, such as pressure loss or insufficient ink supply, can be prevented.

The invention is not limited to the above-described embodiments, but various modifications may be made upon reference to the appended claims.

Figure 8:
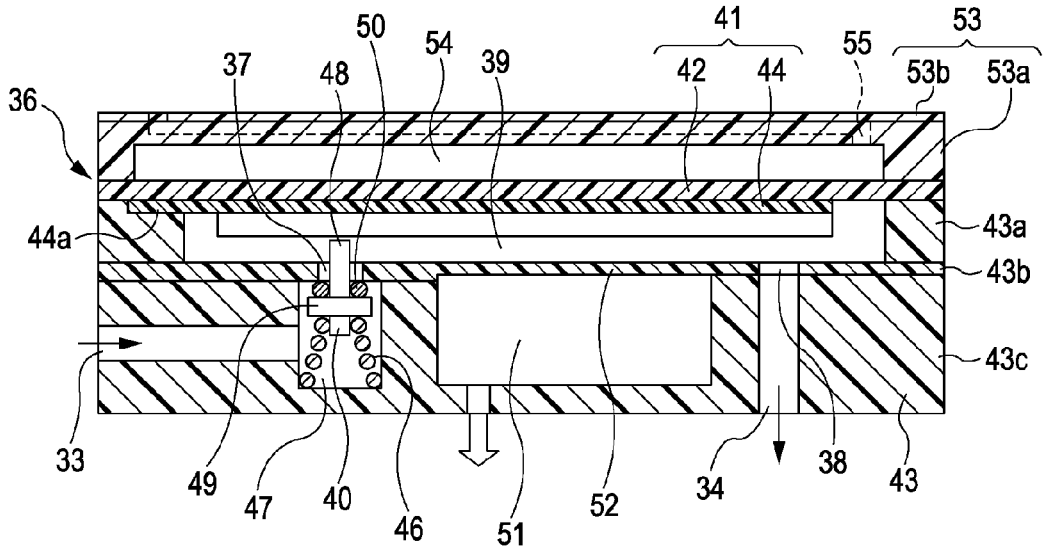
FIG. 8 is a cross-sectional view illustrating the configuration of an ink pressure regulating unit according to a second embodiment of the invention.

In the foregoing embodiment, the transmissive partition wall 52 is integrally formed with the unit main body 43, but the invention is not limited thereto. For example, in a second embodiment shown in FIG. 8, the structure including the transmissive partition wall 52 may be formed separately from the unit main body 43 using a material that has higher gas transmission properties than that of the additional structure.

In the second embodiment, the unit main body 43 is a three-layered structure of a first structure 43*a*, a second structure 43*b*, and a third structure 43*c*. The second structure 43*b* includes the transmissive partition wall 52, which is formed of a material having a gas transmission property higher than other structures 43*a* and 43*c*. Specifically, the transmissive partition wall 52 may be comprised of a plastic, such as m-PPE (modified polyphenylene ether), PP (polypropylene), or an alloy of them. Meanwhile, the other structures 43*a* and 43*c* are preferably formed of a material having a low gas transmission property, such as PPS (polyphenylene sulfide) m-PPE/PPS alloys (alloy of modified polyphenylene ether and polyphenylene sulfide), liquid crystal polymers, or EVOHs (ethylene-vinyl alcohol copolymer resins). Therefore, the transmissive partition wall 52 can have high gas transmission properties, while other portions can be airtight. As a result, gas in the pressure regulating chamber 39 can be efficiently eliminated.

Although, in the embodiments, the cleaning pump unit 14 is used as a pressure reducing unit, the invention is not limited thereto. For example, an additional pump used exclusively to reduce the pressure of the reduced-pressure space portion 51 may be used. In addition, any structure may be used for the pressure reducing unit insofar as it is capable of creating a difference in pressure between the reduced-pressure space portion 51 and the pressure regulating chamber 39.

Finally, the invention is not limited to the printer 1, and may be applied to a variety of liquid ejecting apparatus, including display manufacturing apparatuses, electrode manufacturing apparatuses, chip manufacturing apparatuses, or micropipettes, insofar as a liquid stored in a liquid storage member is introduced into a liquid ejecting head through a liquid supply path.

What is claimed is:

1. A pressure regulating mechanism comprising:

a pressure regulating chamber capable of receiving a liquid from a liquid supply source through an inlet port, storing the liquid, and discharging the stored liquid to an object through an outlet port;

an on/off valve that is capable of switching between a valve open state, wherein the liquid from the inlet port is prevented from entering the pressure regulating chamber, and a valve close state, wherein the liquid is able to flow into the pressure regulating chamber through the inlet port; and a pressure receiving member that is capable of sealing an opening on one side of the pressure regulating chamber, a reduced-pressure space portion formed adjacent to the pressure regulating chamber with a pressure that is capable of being reduced by a pressure reducing unit to less than the pressure in the pressure regulating chamber; and a transmissive partition wall disposed between the reduced-pressure space portion and the pressure regulating chamber which is capable of transferring gas in the pressure regulating chamber to the reduced-pressure space portion using the difference between the pressure in the pressure reducing unit and the pressure in the pressure regulating chamber;

wherein the pressure receiving member is deformed toward the other side of the pressure regulating chamber if a pressure in the pressure regulating chamber is less than a predetermined pressure, causing the on/off valve to switch from the valve close state to the valve open state.

2. The pressure regulating mechanism according to claim 1, wherein the pressure receiving member is formed by providing an airtight layer capable of blocking gas transmission using a flexible film.

3. The pressure regulating mechanism according to claim 1, further comprising:

a sealing space portion is formed outside the pressure regulating chamber with the pressure receiving member interposed between the sealing space portion and the pressure regulating chamber; and a cover member provided to cover the entire surface of the pressure receiving member comprising an air communicating path which connects the sealing space portion with air outside the pressure regulating mechanism.

4. The pressure regulating mechanism according to claim 1, wherein the difference in pressure between the pressure regulating chamber and the reduced-pressure space portion is set such that a transmission speed of gas, or speed at which the gas passes through the transmissive partition wall, is higher than an inflow speed of gas, or speed at which the gas passes through the pressure receiving member and flows into the pressure regulating chamber.

5. The pressure regulating mechanism according to claim 4, wherein the difference in pressure between the pressure regulating chamber and the reduced-pressure space portion is set to be equal to or higher than a saturated water vapor pressure around the pressure regulating chamber at an ambient temperature.

6. The pressure regulating mechanism according to claim 1, wherein the transmissive partition wall comprises a rigid wall having rigidity sufficient to maintain its shape even when the pressure by the pressure reducing unit changed.

7. The pressure regulating mechanism according to claim 6, wherein the transmissive partition wall is a part of a structure that forms a liquid flow passage.

8. The pressure regulating mechanism according to claim 7, wherein the transmissive partition wall is formed in the same structure as the pressure regulating mechanism, using the same material as the structure, with a thickness that is smaller than the thickness of the portion of the structure where the pressure regulating mechanism comes into contact with external air.

9. The pressure regulating mechanism according to claim 7, wherein the transmissive partition wall is formed of a material that is different than the material used to form the pressure regulating mechanism which has transmission properties that are higher than the material used to form the pressure regulating mechanism.

10. A liquid ejecting apparatus comprising:

the pressure regulating mechanism according to claim 1, wherein a liquid stored in a liquid storage member is introduced into the pressure regulating mechanism through a liquid supply path which is regulated by the pressure regulating mechanism, supplied to a liquid ejecting head, and discharged by the liquid ejecting head.

11. The liquid ejecting apparatus according to claim 10, further comprising:

a gas trapping space portion is formed in the liquid supply path from the liquid storage member to the inlet port of the pressure regulating mechanism which is capable of trapping gas in the liquid supply path;

a gas collecting space portion formed outside the gas trapping space portion; and a transmissive partition wall disposed between the gas collecting space portion and the gas trapping space portion comprising a partition wall which partitions the gas trapping space portion;

wherein the pressure in the gas collecting space portion is reduced to be less than the pressure in the gas trapping space portion by an pressure reducing unit, such that gas in the gas trapping space portion passes through the transmissive partition wall and is discharged to the gas collecting space portion.

12. A pressure regulating mechanism comprising:

a pressure regulating chamber capable of receiving a liquid from a liquid supply source through an inlet port, storing the liquid, and discharging the stored liquid to an object through an outlet port;

an on/off valve that is capable of switching between a valve open state, wherein the liquid from the inlet port is prevented from entering the pressure regulating chamber, and a valve close state, wherein the liquid is able to flow into the pressure regulating chamber through the inlet port; and a pressure receiving member that is capable of sealing an opening on one side of the pressure regulating chamber and deforming toward the other side of the pressure regulating chamber if a pressure in the pressure regulating chamber is less than a predetermined pressure, causing the on/off valve to switch from the valve close state to the valve open state, a reduced-pressure space portion formed adjacent to the pressure regulating chamber with a pressure that is capable of being reduced by a pressure reducing unit to less than the pressure in the pressure regulating chamber; and a transmissive partition wall disposed between the reduced-pressure space portion and the pressure regulating chamber comprising a rigid wall having rigidity sufficient to maintain its shape when the pressure reducing unit changes the pressure in the reduced-pressure space portion while transferring gas in the pressure regulating chamber to the reduced-pressure space portion;

wherein the difference in pressure between the pressure regulating chamber and the reduced-pressure space portion is set such that a transmission speed of gas, or speed at which the gas passes through the transmissive partition wall, is higher than an inflow speed of gas, or speed at which the gas passes through the pressure receiving member and flows into the pressure regulating chamber.

13. The pressure regulating mechanism according to claim 12, wherein the difference in pressure between the pressure regulating chamber and the reduced-pressure space portion is set to be equal to or higher than a saturated water vapor pressure around the pressure regulating chamber at an ambient temperature.

14. The pressure regulating mechanism according to claim 12, wherein the transmissive partition wall is a part of a structure that forms a liquid flow passage.

15. The pressure regulating mechanism according to claim 14, wherein the transmissive partition wall is formed in the same structure as the pressure regulating mechanism, using the same material as the structure, with a thickness that is smaller than the thickness of the portion of the structure where the pressure regulating mechanism comes into contact with external air.

16. The pressure regulating mechanism according to claim 14, wherein the transmissive partition wall is formed of a material that is different than the material used to form the pressure regulating mechanism which has transmission properties that are higher than the material used to form the pressure regulating mechanism.

* * * * *